US006039604A

United States Patent [19]

Tindall

[11] Patent Number: 6,039,604

[45] Date of Patent: Mar. 21, 2000

[54] CABLE COUPLING ASSEMBLY

[75] Inventor: Glenn Andrew Tindall, North Parramatta, Australia

[73] Assignee: Metal Manufactures Limited, New South Wales, Australia

[21] Appl. No.: 09/006,949

[22] Filed: Jan. 14, 1998

Related U.S. Application Data

[63] Continuation-in-part of application No. 08/772,843, Dec. 24, 1996, abandoned.

[30] Foreign Application Priority Data

Sep. 30, 1996 [AU] Australia ..... PO2684

[51] Int. Cl.[7] ..... H01R 13/40

[52] U.S. Cl. ..... 439/598; 439/891; 439/934

[58] Field of Search ..... 439/598, 891, 439/686, 589, 934

[56] References Cited

FOREIGN PATENT DOCUMENTS

| | | |
|---|---|---|
| 1822888 | 1/1989 | Australia . |
| 1473592 | 10/1992 | Australia . |
| 0136156 | 4/1985 | European Pat. Off. . |
| 2029129 | 3/1980 | United Kingdom . |
| 2077523 | 12/1981 | United Kingdom . |
| 2079547 | 1/1982 | United Kingdom . |
| 2206460 | 1/1989 | United Kingdom . |

*Primary Examiner*—Steven L. Stephan
*Assistant Examiner*—T C Patel
*Attorney, Agent, or Firm*—Leydig, Voit & Mayer, Ltd.

[57] ABSTRACT

An electrical cable coupling assembly includes six equally angularly spaced axially extending tubular insulators which have a central internal annular ridge against which a thimble and a socket are collectively secured by the operation of a bolt. A phase barrier, which is a structural member, is engaged at opposed ends by respective plates. The plates are forced toward each other and into clamping engagement with insulators by the action of bolts which are threadedly engaged within complementary bores in the phase barrier.

19 Claims, 9 Drawing Sheets

CABLE COUPLING ASSEMBLY

REFERENCE TO RELATED APPLICATIONS

This application is a continuation-in-part of U.S. patent application Ser. No. 08/772,843, filed on Dec. 24, 1996, now abandoned and International Application Number AU97/00651, filed on Sep. 30, 1997, both of which are incorporated by reference.

BACKGROUND OF THE INVENTION

1. Field of the Invention

The present invention relates to an electrical cable coupling assembly.

2. Description of the Related Art

The invention has been primarily developed for medium to high voltage and/or medium to high current multicore power supply cables such as those used in the underground mining industry and will be described hereinafter with reference to that application. However, it will be appreciated that the invention is not limited to that particular field of use.

Known electrical cable couplings for power supply cables used in underground mines have generally included an axially extending cylindrical body which is configured at one end for insertion into a complementary coupling having a number of connector pins. The other end of the body is configured to receive a multi-core cable.

Within the body the ends of the cable cores are electrically connected to respective internal contacts which, in turn, selectively electrically engage with the connector pins within the complementary coupling.

As it is necessary to insulate the ends of the various cores in the multicore cable from each other the body generally includes a one piece moulded insulator which surrounds the internal contacts and allows them to contact only a respective connector pin. An example of a known electrical cable coupling assembly is illustrated in FIGS. 1 and 2 and will be described below in more detail.

The known couplings are particularly disadvantageous as they are heavy and the insulator is prone to damage and is difficult to replace without at the same time replacing all the internals of the body. In a mine environment where operating conditions are harsh the known couplings are particularly undesirable as they are expensive to maintain in safe working condition.

SUMMARY OF THE INVENTION

It is an object of the present invention, at least in the preferred embodiment, to overcome or substantially ameliorate this disadvantage of the prior art.

According to a first of the invention there is provided an electrical cable coupling assembly including:

a body having a first end configured for receiving a complementary coupling assembly and a second end configured for receiving an electrical cable having at least one core;

at least one conductive connector adapted to receive a core at one end and a conductive connector member associated with the complementary coupling assembly at the other end to allow electrical correction between the core and the corresponding connector member, and releasable electrical connection between the core and a corresponding core in the complementary coupling assembly; and at least one substantially tubular insulator captively retained at least partially in the body and at least partially enveloping a compounding connector.

Preferably the tubular insulators tube insulators are captively retained by at least one captive fitting coupled to the body.

Preferably two captive fittings are provided, each fitting including an aperture in axial alignment with a corresponding insulator located at least partially in the two fittings.

Preferably the two fittings are coupled to each other to selectively locate and clamp each insulator at least partially in between the two fittings.

Preferably each fitting includes a plate, wherein one plate is selectively located at the first end of the body and the other plate is selectively located intermediate the first and second ends of the body.

Preferably the coupling assembly includes a coupling member extending and captively retained between the two plates.

Preferably the coupling member is a conductive phase barrier.

Preferably the coupling member is coupled to the two plates to selectively clamp each insulator at least partially in between the two plates.

Preferably each insulator is substantially cylindrical.

Optionally the at least one insulator has a non-circular cross-section.

Preferably the assembly includes a plurality of insulators and corresponding connectors which are substantially equally angularly spaced about a longitudinal as of the coupling assembly.

Preferably each insulator is at least partially enveloped by a corresponding outer tubular insulator.

Preferably each insulator where each insulator is separated from the corresponding outer insulator by an air gap.

Preferably each connector is metallic.

Preferably each insulator includes a plastic sleeve.

Alteratively, each insulator is formed by a layer of ceramic material deposited on the outside of the corresponding connector.

Preferably each fitting includes a solid conductive core and each aperture is defined by an axially extending passage in the conductive core through which the corresponding insulator at least partially extends.

Preferably the conductive core is generally cylindrical, earthed, and metallic.

A second aspect of the invention provides an electrical cable coupling assembly including:

a body having a first end for receiving a complementary coupling assembly and a second end for receiving an electrical cable having at least one core;

at least one substantially tubular insulator mounted to the body and having a conductive connector mounted within for receiving a core at a first end and a conductive member associated with the complementary coupling assembly at a second end to allow both electrical connection between the core and the corresponding electrical connector and releasable electrical connection between the core and a corresponding core in the complementary coupling assembly.

Preferably the second end of the at least one connector extends beyond the body.

Preferably the at least one insulator is mounted to the body by a fitting means.

Preferably the fitting means includes an aperture for each insulator adapted to receive at least a portion of the insulator, and a locating formation for releasably coupling with a complimentary formation on the body.

Preferably the fitting means includes retention means for captively raining at least a portion of the insulator with the corresponding aperture.

Preferably the fining means is electrically conductive.

BRIEF DESCRIPTION OF THE DRAWINGS

Some preferred embodiments of the invention will now be described, by way of example only, with reference to the accompanying drawings in which:

FIG. 12 is a schematic transverse cross section of a portion of a variation of the embodiment of FIG. 4 including two coaxial insulators separated by an air gap.

DESCRIPTION OF PREFERRED EMBODIMENTS

Figure 1:
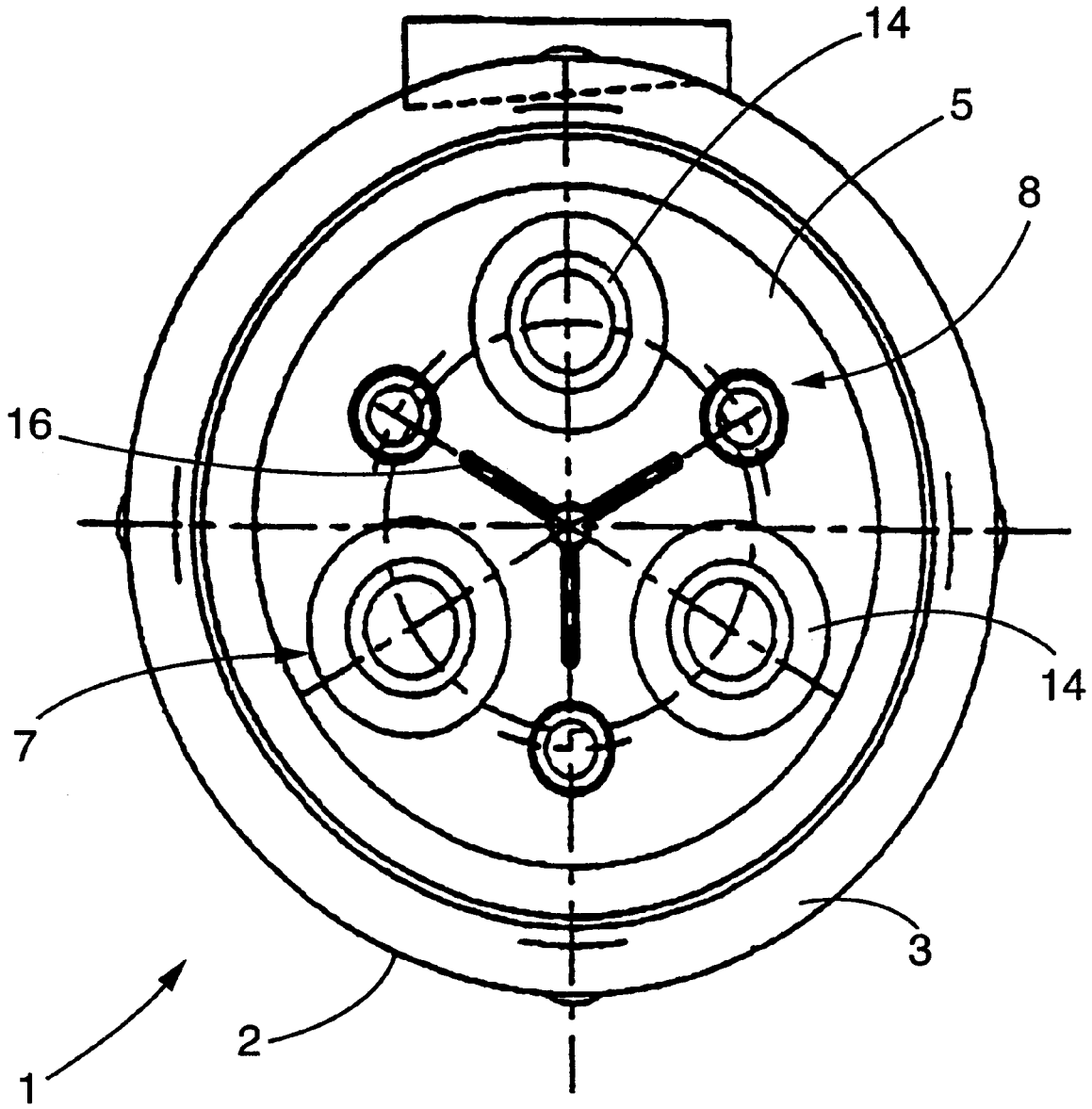
FIG. 1 PRIOR ART
FIG. 1 is an end view of a known electrical cable coupling assembly.
Figure 2:
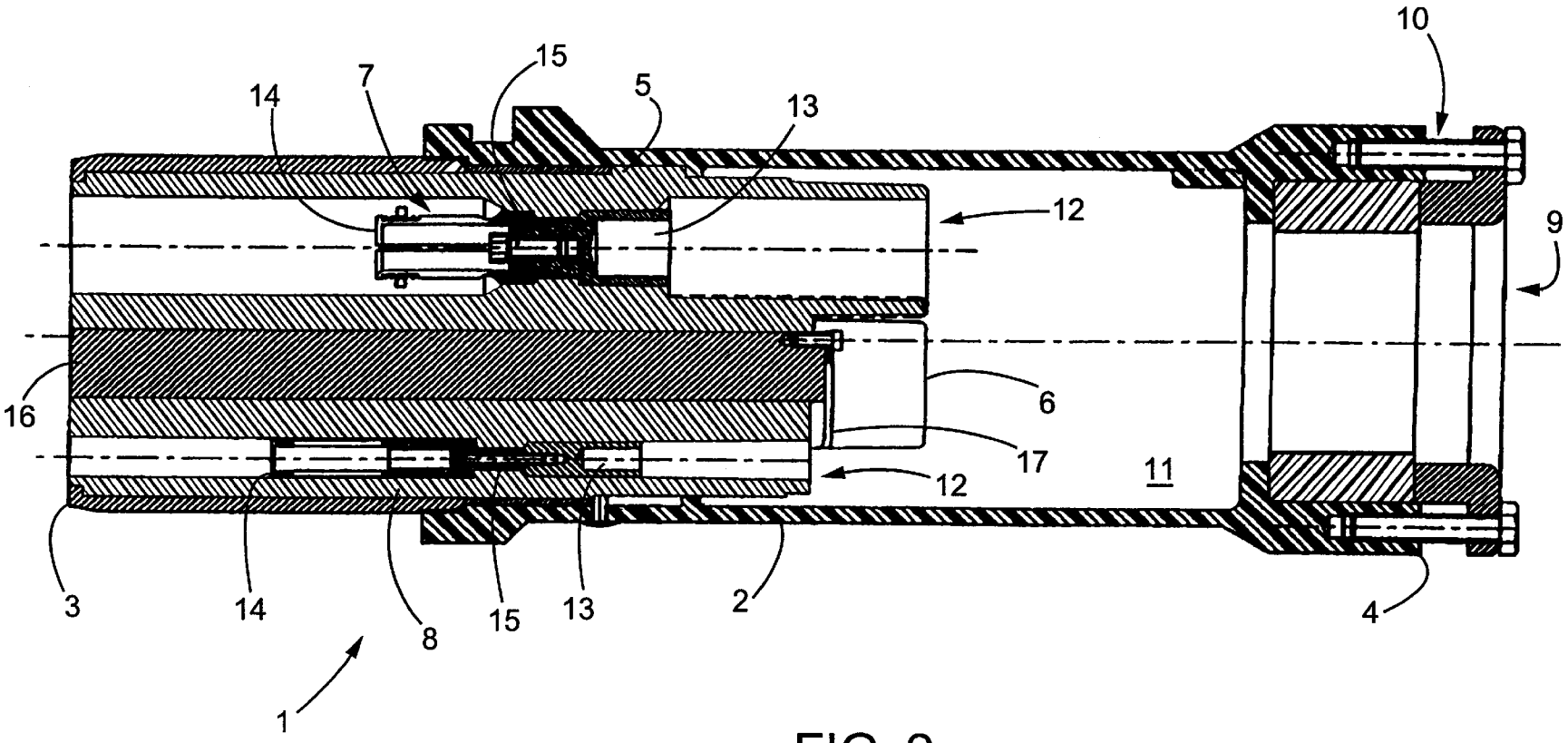
FIG. 2 PRIOR ART
FIG. 2 is a cross section taken along line 2—2 in FIG. 1.

Reference is made to the prior art electric cable coupling assembly 1 of FIGS. 1 and 2. The Assembly 1 includes a generally cylindrical body 2 extending between a first end 3 and a second end 4 which are configured respectively for insertion into a corresponding coupling assembly (not shown) and receiving a multi-core electrical cable (not shown). As is well known to those in the art, multi-core cables generally include three equally spaced apart medium or high voltage mains conductors and one or more pilot cores for carrying communication signals. Body 2 includes a single piece moulded interior insulator 5 which extends from end 3 and terminates at end 6, which lies intermediate ends 3 and 4. Insulator 5 surrounds two differently sized sets of three connectors 7 and 8 which, at one end, receive the cores of the cable and, at the other end, receive connector pins (not shown) located within the complementary coupling. Accordingly, electrical connection is selectively provided between the cores in the cable and the connector pins within the complementary assembly. One such complementary coupling is described and illustrated in Australian Patent Application No. 21600/95, the disclosure of which is incorporated herein by way of cross reference.

The end of the cable is received in an aperture 9 at end 4 of body 2 and subsequently secured by clamping means 10. The cores of the cable are separated in internal chamber 11 and inserted into respective cylindrical bores 12 insulators 5 and is secured to connectors 7 or 8, as appropriate.

Connectors 7 and 8 each include at one end a thimble 13 for receiving the free end of a respective cable core, as is known to those skilled in the art. The end of the core is soldered or otherwise connected to thimble 13. Each connector also includes, at its other end, a socket 14 for receiving a respective connector pin located within the receptacle. That is, the connector pins are received into engagement with respective sockets 14 when plug 1 is inserted into the complementary coupling. The respective pairs of thimble 13 and contact 14 are maintained in abutting electrical engagement by bolts 15.

Insulator 5 also encases a phase barrier 16 which is a centrally located metal structure having three legs which extend radially outwardly between adjacent conductors. Barrier 16 is earthed via lead 17 and reduces the risk of phase to phase faults. In alternative embodiments barrier 16 includes a different number of legs.

Figure 3:
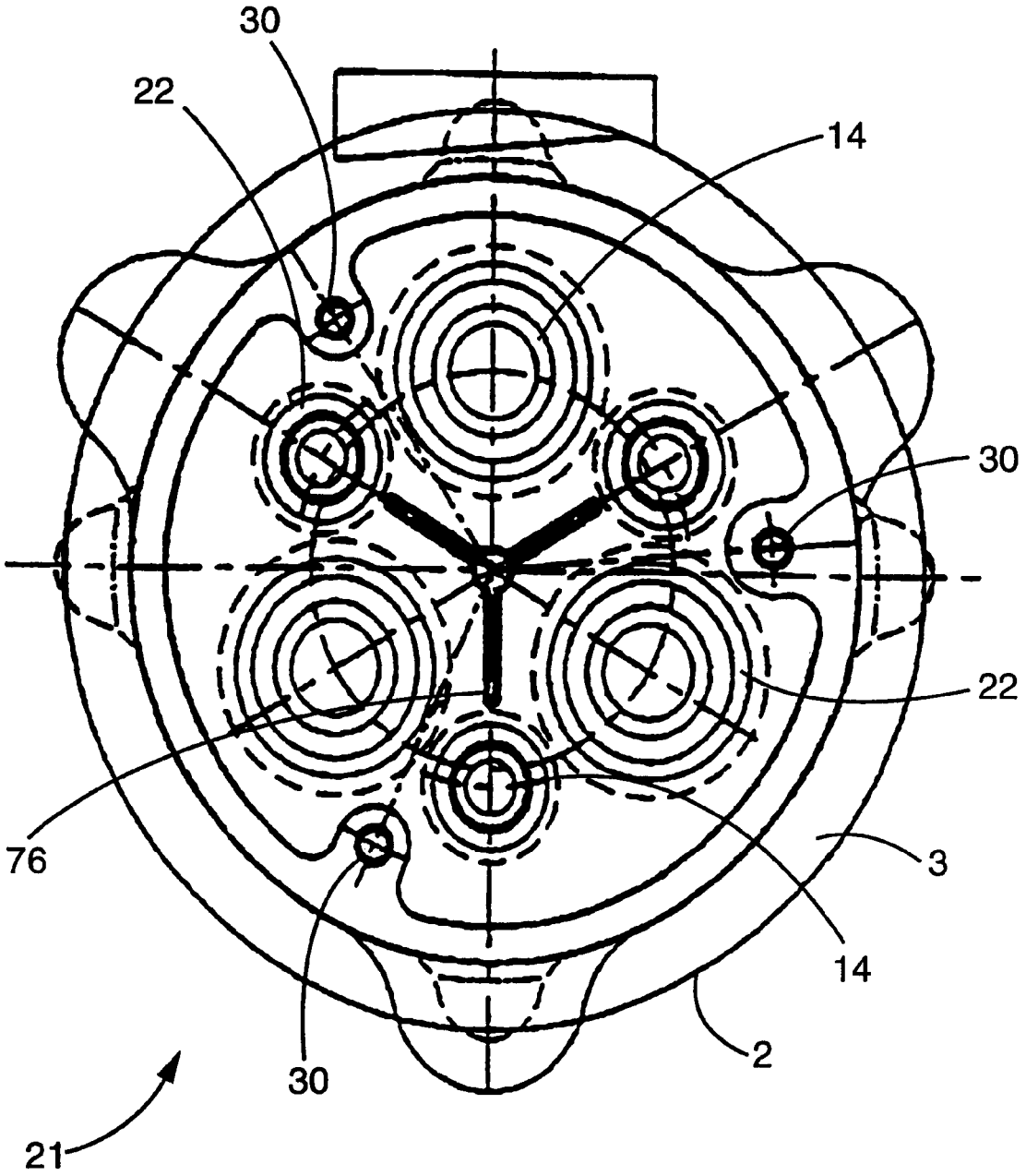
FIG. 3 is an end view of an embodiment of an electrical cable coupling assembly in accordance with the invention.
Figure 4:
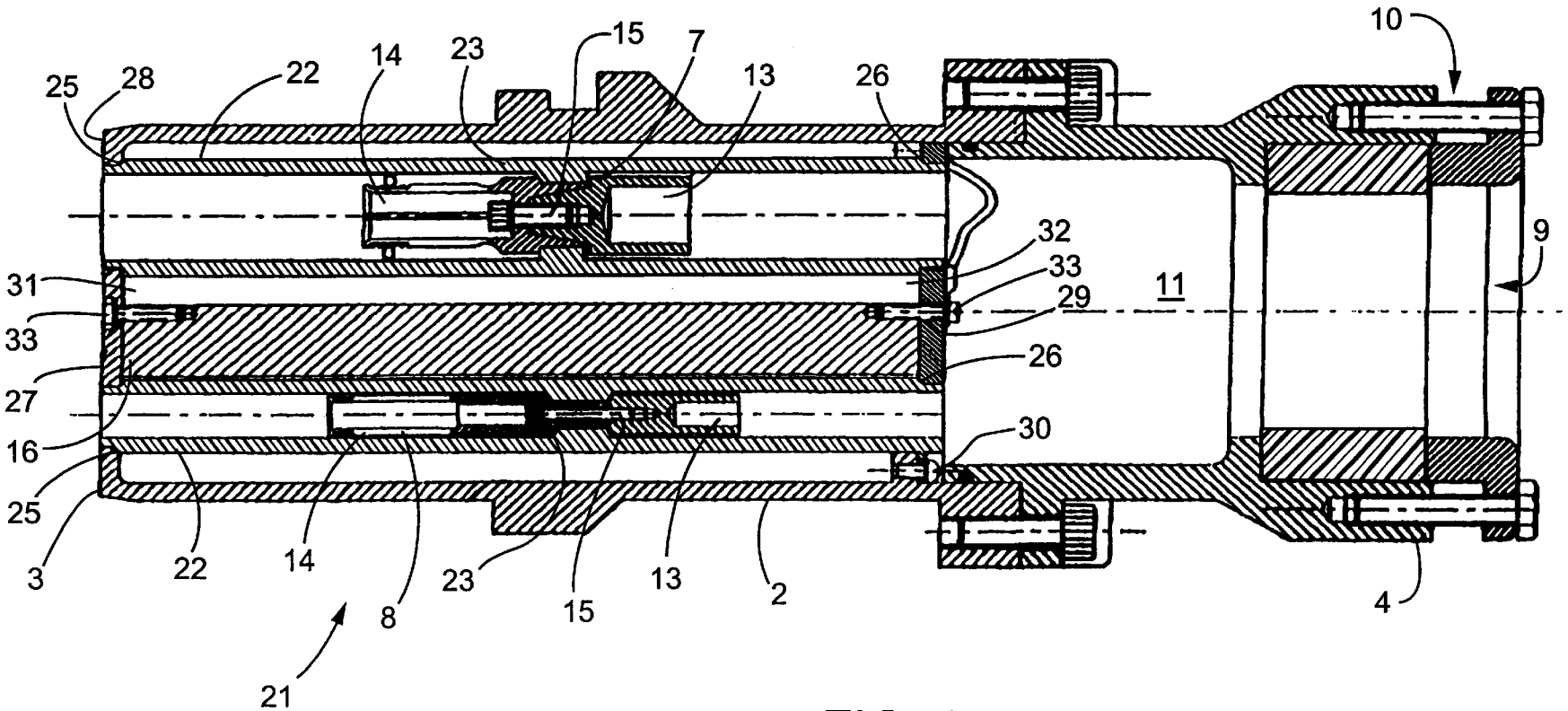
FIG. 4 is a cross section taken along line 4—4 in FIG. 3.

Referring now to FIGS. 3 and 4, there is illustrated an electrical cable coupling assembly 21 according to the invention. The features of assembly 21 which correspond with those of assembly 1 are denoted by corresponding reference numerals.

Assembly 21 includes six equally angularly spaced axially extending tubular insulators 22 which, best shown in FIG. 4, have a central internal annular ridge 23 against which thimble 13 and socket 14 are collectively secured by the operation of bolt 15. It will be appreciated that thimble 13 and socket 14 provide the same function as described above with respect to prior art assembly 1.

Although in this embodiment insulators 22 are made from polyester, other insulating materials are used in other embodiments, for example, rubber, reinforced resin or ceramics. Moreover, as schematically shown in FIG. 12, in very high voltage applications each insulator 22 extends within a co-axially disposed additional insulator (22*a*) to eve greater electrical isolation between the cores and connectors 7 and 8. Preferably, the internal diameter of the additional insulator 22*a* is sufficiently grater than the external diameter of insulator 22 to provide an air gap 22*b*.

Each insulator 22 includes at opposed ends annular shoulders 25 and 26 for abutting a complementary formation to retain the insulators in a fixed configuration respect to body 2. At end 3 of body 2, that complementary formation is defined by the combination of a circular aperture plate 27 and an annular lip 28 which inwardly extends from end 3. Plate 27 includes a plurality of apertures which receive the ends of insulator 22, whereby plate 27 abuts against shoulder 25.

At the other end of insulators 22, the complementary formation is defined by a circular plate 29 which includes apertures corresponding to those in plate 27. These apertures in plate 27 interact similarly with shoulders 26 of the insulators.

Both plates 27 and 29 are secured to body 2 by way of circumferentially spaced rivets 30. Moreover, these plates are structural members and provide additional strength to assembly 21 and, accordingly, increase the useful lifetime of the product. Moreover, assembly 21 provides this additional strength while being lighter than the prior art assembly 1.

In this embodiment barrier 16 is also a structural member being engaged at opposed ends 31 and 32 by respective plates 27 and 29. The plates are forced toward each other and into clamping engagement with insulators 22 by the action of bolts 33 which are threadedly engaged within complementary bores in barrier 16.

In other embodiments only the cores in the cable carrying supply voltages are within insulators 22, the pilot lines being of sufficiently low voltage that the intermediate air gap is adequate to prevent arcing therebetween.

In some embodiments, once the cable is installed within cavity 11, that cavity is filled with an expandable compound via a filling aperture (not shown). The compound stress relieves the cable termination and reduces the possibility of water ingress from outside the cable and plug, or through water entrapment within the cable (a function of the cable manufacturing process).

Plate 27 is produced from a metal or hard plastics material and, accordingly, is resistant to damage from inadvertent contact with other objects. In the event plate 27 is damaged it can be easily replaced.

Figure 5:
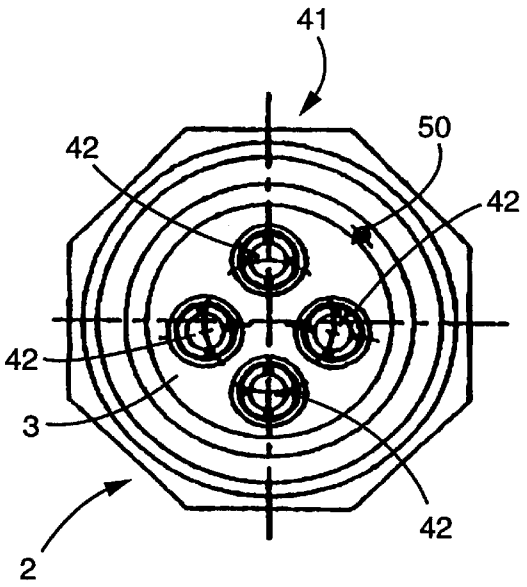
FIG. 5 is an end view of another embodiment of a cable coupling assembly in accordance with the invention.
Figure 6:
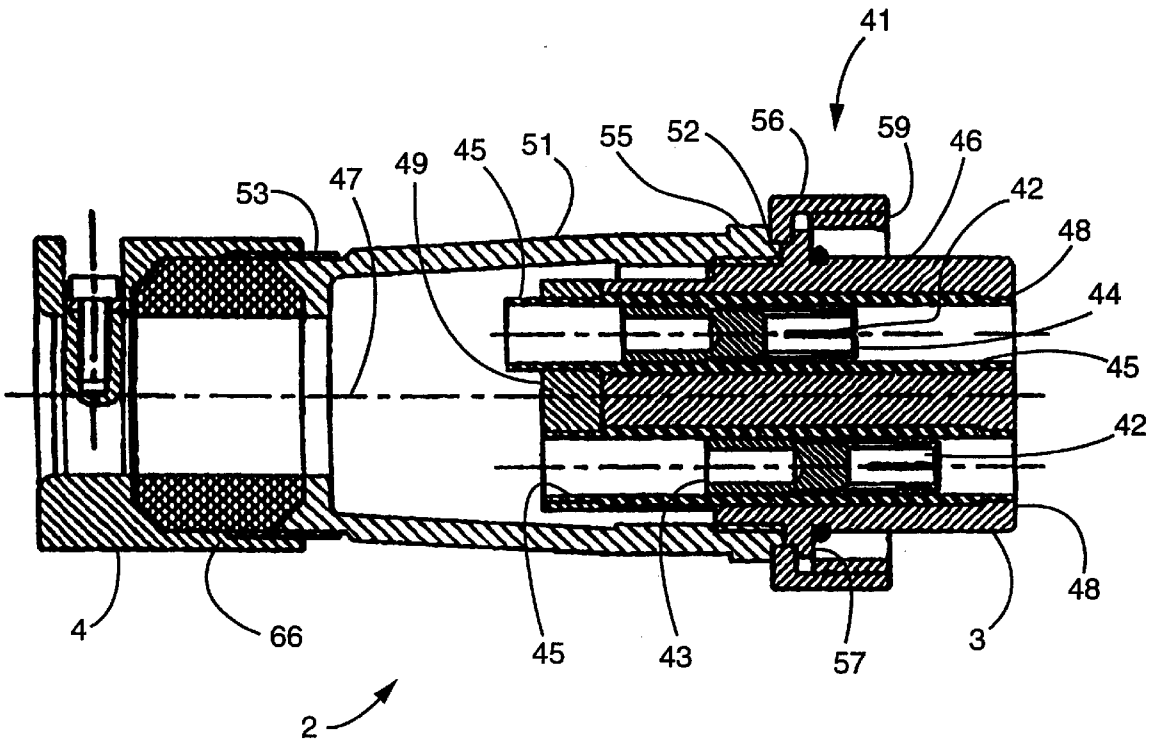
FIG. 6 is a cross section taken along line 6—6 of FIG. 5.
Figure 7:
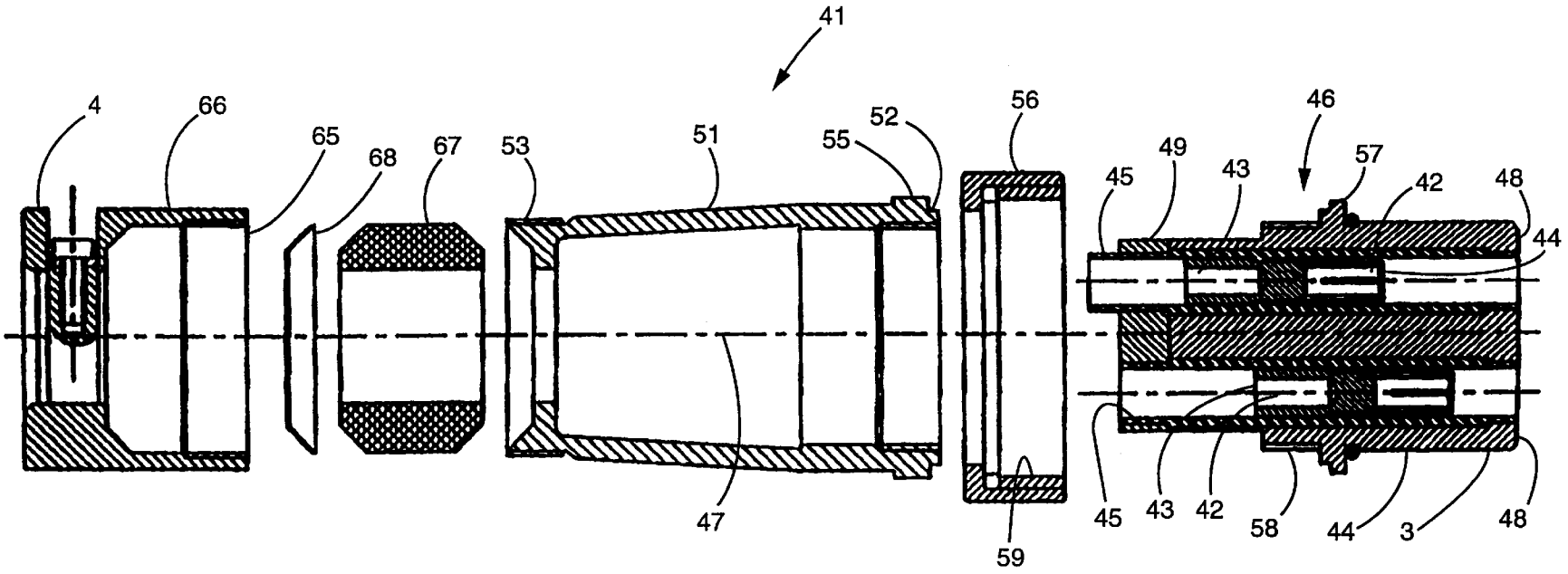
FIG. 7 is an exploded cross sectional view of the embodiment in FIG. 6.
Figure 8:
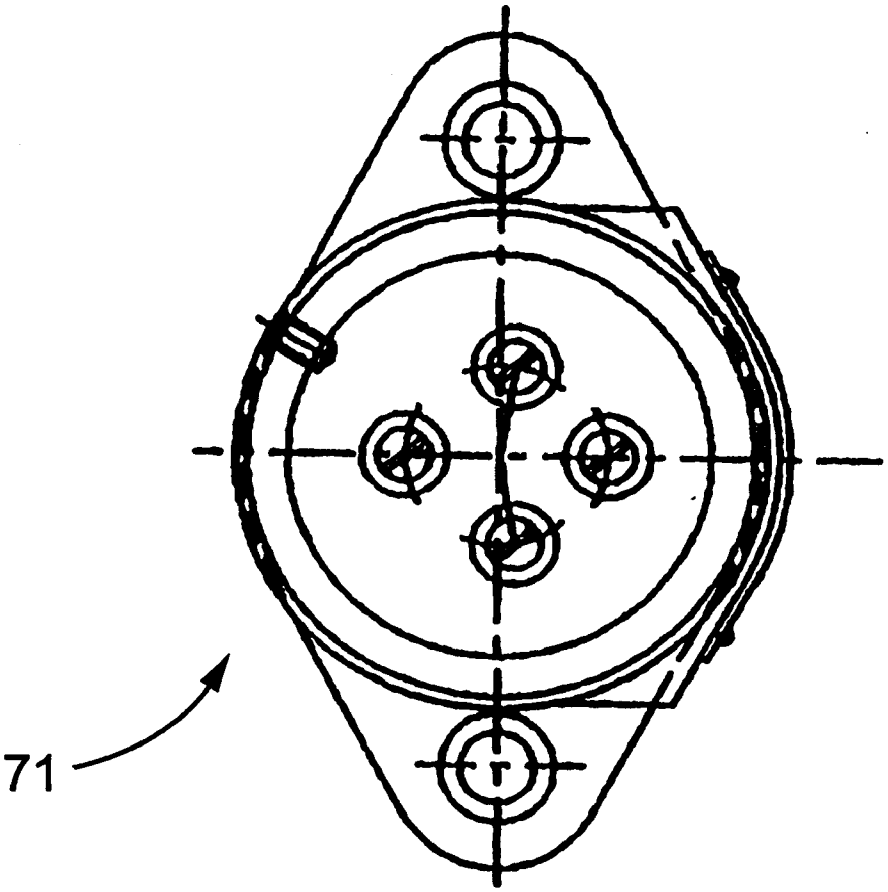
FIG. 8 is an end view of an embodiment of a portion of a cable coupling assembly in accordance with the invention.
Figure 10:
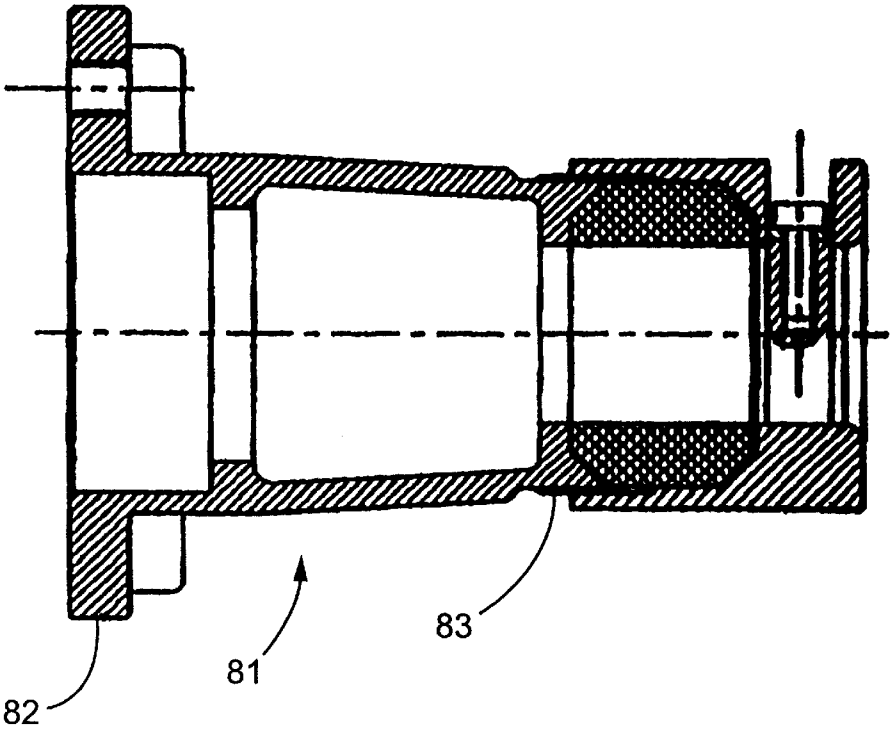
FIG. 10 is a cross sectional view of a portion of a cable coupling assembly suitable for use with the portion illustrated in FIG. 9.
Figure 9:
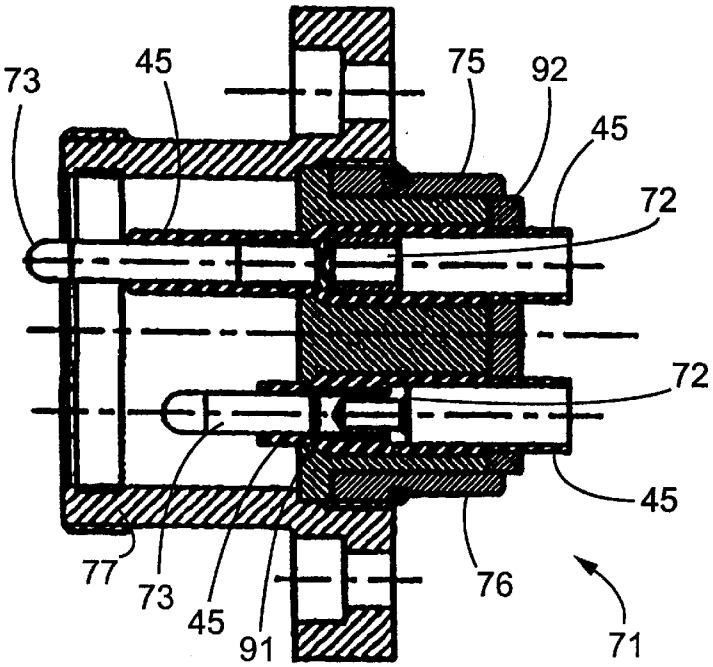
FIG. 9 is a cross section view taken along line 9—9 in FIG. 8.
Figure 11:
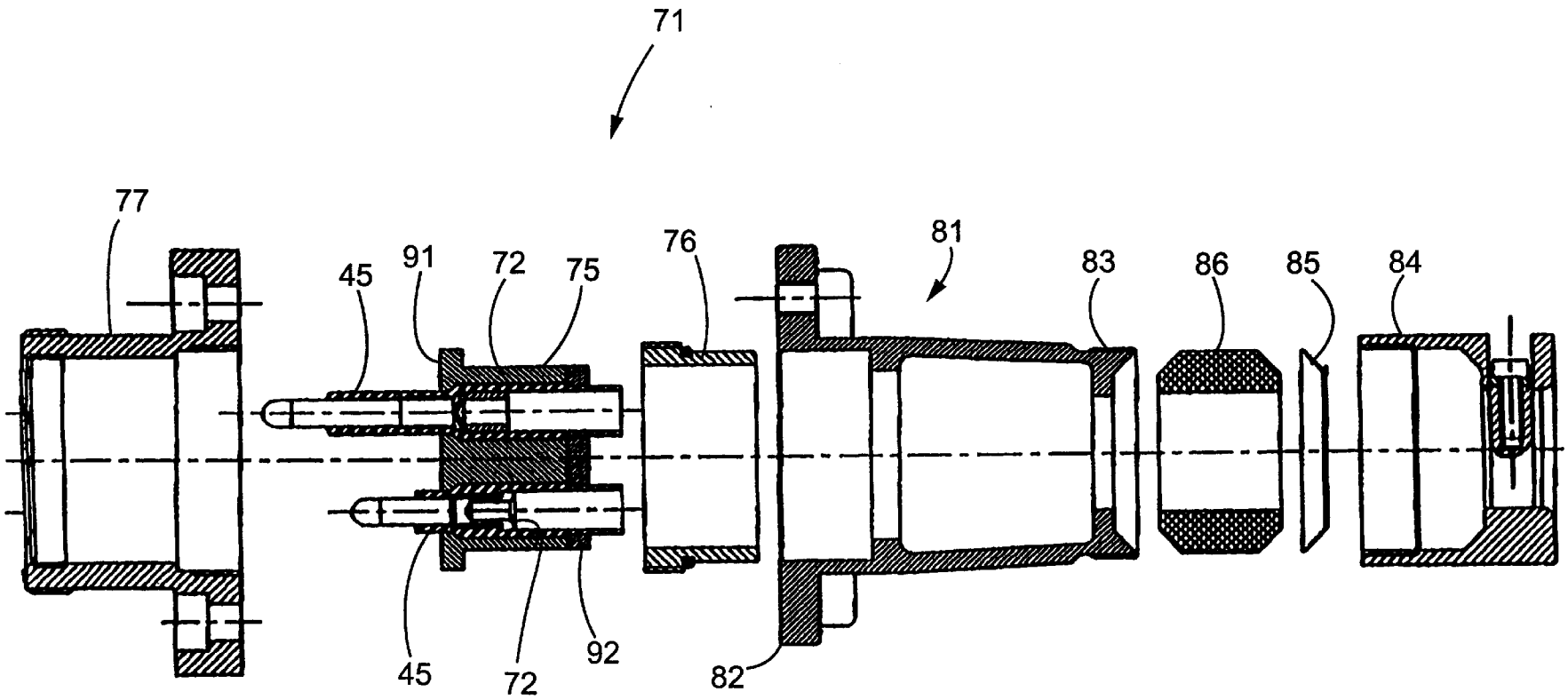
FIG. 11 is a partially exploded cross sectional view of FIGS. 9 and 10.

Reference is now made to an alternative electrical assembly 41 according to the invention which is illustrated in FIGS. 5, 6 and 7. Where appropriate corresponding features have been denoted by corresponding reference numerals. More particularly, assembly 41 includes a body 2 which extends between a first end 3 and a second end 4. These ends 3 and 4 are respectively configured for engagement with a complementary coupling assembly (not shown) and receiving an electrical cable (not shown) having four cores. Assembly 41 also includes four spaced apart connectors 42 for receiving at respective first ends 43 the cores and at respective second ends 44 a connector formation associated with the complementary plug to allow releasable electrical connection between the cores and the connector formations. Four insulating sheaths 45 extend about respective connectors 42 for electrically isolating connectors 42 from each other.

Connectors 42 are metallic and, as plug 41 is intended for low to medium voltage applications, sheaths 45 are plastics sleeves. In higher voltage applications, sheaths 45 are defined by a layer of ceramic material which is deposited on the outside of connectors 42. This arrangement effectively eliminates any air gap between the connectors 42 and the respective surrounding inslating sheaths 45 and thereby prevents corona discharge about those connectors.

Body 2 includes a generally cylindrical solid conductive core in the form of a nose cone 46 which extends along an axis 47 and which has four spaced apart parallel axially extending passages through which sheaths 45 extend. In this embodiment cone 46 is both metallic and earthed. Accordingly, cone 46 functions not only as a mechanical support for plug 41 but also as a phase barrier.

Cone 46 includes, at one end, shoulders 48 which extend across the periphery of the adjacent passages to provide an abutment for one end of sheaths 45. Cone 46 also includes, at its other end, a conductive core in the form of a removable end cap 49 which also extends across the periphery of the passages to provide an abutment for the other ends of sheaths 45. The combination of shoulders 48 and cap 49 captively retains sheaths 45 within cone 46.

In this embodiment, cap 49 is retained to cone 46 by a bolt 50 which is offset from the passages. In other embodiments different attachment means are used.

Body 2 includes a hollow cylindrical housing 51 which extends along axis 47 between a first end 52 and a second end 53 which are respectively threaded internally and externally. End 52 also includes an abutment formation 55 for receiving a coupling nut 56. Moreover, cone 46 includes an abutment formation 57 and an external thread 58. When thread 58 is engaged with end 52, as shown in FIG. 6, nut 56 is captively retained between formations 55 and 57 for rotation about axis 47. Nut 56 includes an internal thread 59 for selectively engaging with a complementary thread of the electrical plug or receptacle.

End 53 is received within the complementary internally threaded end 65 of a backnut 66. Sandwiched between end 53 and backnut 66 is a rubber grommet 67 and a washer 68. As will be appreciated by those skilled in the art, as the threaded engagement between backnut 66 and end 53 is increased, grommet 67 is compressed and therefore moves into a more intimate seating and clamping engagement with the cable extending into housing 51.

Another electrical assembly 71 according to the invention is illustrated in FIGS. 8 to 11 where, for convenience, corresponding features are denoted by corresponding reference numerals. In this embodiment assembly 71 includes connectors 72 having four spaced apart axially extending pins 73 for engaging within corresponding as in a complementary assembly such as assembly 41. Connectors 72 are housed within sheaths 45 and, as such, are insulated from each other. Moreover, the connector and shed combinations are located within respective axial passages of a conductive core in the form of a generally cylindrical conductive former 75. Former 75 is threaded to a tubular first and second body portions 76 and 77 and functions similarly to nose cone 46.

Assembly 71 also includes a second tubular body portion 81 which extends between a first end 82 and an axially spaced apart second end 83. End 83 is, in use, captively engaged with a respective backnut 84, washer 85 and grommet 86, similarly to end 53 of housing 51.

Former 75 includes a shoulder 91 adjacent one end, and a conductive core in the form of a an end cap 92 adjacent the other end, for providing opposed abutments for sheaths 45. These abutments retain sheaths 45 and connectors 42 within the passages in former 75.

Preferably, cone 46 and former 75 are cast from copper and machined to include the respective passages.

A cable coupling assembly produced in accordance with the preferred embodiments of the invention offers a more durable and cost effective product which provides the necessary insulation between the cores at a weight significantly less than corresponding prior art assemblies. By way of example, assembly 21 is approximately 20% lighter than prior art assembly 1.

Although the invention has been described with reference to a particular example it will be appreciated by those skilled in the art Mat it may be embodied in any other forms.

What is claimed is:

1. An electrical cable coupling assembly including:

a body having a first end configured for receiving a complementary coupling assembly and a second end configured for receiving an electrical cable having a plurality of cores;

a plurality of conductive connectors each adapted to receive a a corresponding one of the cores at one end and a corresponding conductive connector member associated with the complementary coupling assembly at the other end to allow electrical connection between the corresponding core and the corresponding connector member, and releasable electrical connection between the corresponding core and a corresponding core in the complementary coupling assembly;

a plurality of substantially tubular insulators each captively retained at least partially in the body and at least partially enveloping a corresponding one of the connectors;

a first plate disposed at the first end of the body and coupled to the body and having a plurality of apertures each of which is in axial alignment with one of the insulators; and a second plate spaced from the first plate and disposed between the first and second ends of the body and coupled to the body and to the first plate and having a plurality of apertures each of which is in axial alignment with one of the insulators, each of the insulators being clamped at least partially between the first and second plates.

2. The coupling assembly according to claim 1 further including a coupling member extending and captively retained between the two plates.

3. The coupling assembly according to claim 2 wherein the coupling member is a conductive phase barrier.

4. The coupling assembly according to claim 2 wherein the coupling member is coupled to the two plates to selectively clamp each insulator at least partially in between the two plates.

5. The coupling assembly according to claim 1 wherein each insulator is substantially cylindrical.

6. The coupling assembly according to claim 1 wherein the insulators and connectors are substantially equally angularly spaced about a longitudinal axis of the coupling assembly.

7. The coupling assembly according to claim 1 wherein each insulator is at least partially enveloped by a corresponding outer tubular insulator.

8. The coupling assembly according to claim 7 wherein each insulator is separated from the corresponding outer insulator by an air gap.

9. The coupling assembly according to claim 1 wherein each connector is metallic.

10. The coupling assembly according to claim 8 wherein each insulator includes a plastics sleeve.

11. An electrical cable coupling assembly comprising:

a body having a first end configured for receiving a complementary coupling assembly and a second end configured for receiving an electrical cable having a plurality of cores;

a plurality of conductive connectors each adapted to receive a corresponding one of the cores at one end and a corresponding conductive connector member associated with the complementary coupling assembly at the other end to allow electrical connection between the corresponding core and the corresponding connector member, and releasable electrical connection between the corresponding core and a corresponding core in the complementary coupling assembly;

a plurality of substantially tubular insulators each captively retained at least partially in the body and at least partially enveloping a corresponding one of the connectors; and two captive fittings coupled to the body and captively retaining each insulator, each fitting including an aperture in axial alignment with a corresponding one of the insulators located at least partially in between the two fittings, the two fittings being coupled to each other to selectively locate and clams each insulator at least partially between the two fittings, each fitting including a solid conductive core and each aperture being defined by an axially extending passage in the conductive core through which the corresponding insulator at least partially extends.

12. The coupling assembly according to claim 11 wherein at least one of the conductive cores is generally cylindrical.

13. The coupling assembly according to claim 11 wherein at least one of the conductive cores is earthed.

14. The coupling assembly according to claim 11 wherein at least one of the conductive cores is metallic.

15. The coupling assembly according to claim 1 wherein each insulator includes a shoulder at each of its ends which abuts against one of the plates to restrain the insulator.

16. The coupling assembly according to claim 1 wherein each plate is detachably secured to the body.

17. The coupling assembly according to claim 1 wherein the first plate closes off an end of the body.

18. The coupling assembly according to claim 1 wherein each of the insulators is spaced from an interior of the body by an air gap.

19. The coupling assembly according to claim 3 wherein the plates abut against the phase barrier.

* * * * *